US006079856A

United States Patent [19]

Prestier

[11] Patent Number: 6,079,856

[45] Date of Patent: Jun. 27, 2000

[54] LIGHT FIXTURE THERMAL INSULATOR

[76] Inventor: Douglas J. Prestier, 842 S. Main St., North Canton, Ohio 44720

[21] Appl. No.: 09/213,118

[22] Filed: Dec. 17, 1998

[51] Int. Cl.[7] ..... F21V 21/00; F21V 15/01

[52] U.S. Cl. ..... 362/365; 362/145; 362/147

[58] Field of Search ..... 362/364, 365, 362/368, 145, 147, 148, 150

[56] References Cited

U.S. PATENT DOCUMENTS

| | | | |
|---|---|---|---|
| 2,717,955 | 9/1955 | Schwemmer et al. | 362/148 X |
| 4,459,648 | 7/1984 | Ullman | 362/147 X |
| 4,890,200 | 12/1989 | Mandy | 362/148 X |
| 5,931,432 | 8/1999 | Herold et al. | 362/365 X |
| 5,941,625 | 8/1999 | Morand | 362/365 X |

FOREIGN PATENT DOCUMENTS

| | | | |
|---|---|---|---|
| 54-120984 | 9/1979 | Japan | 362/147 |

*Primary Examiner*—Laura K. Tso

[57] ABSTRACT

An insulated light fixture assembly is provided including an insulation housing having a side wall defining a bottom opening. The insulation housing includes a peripheral flange mounted to the side wall and extending outwardly therefrom adjacent to the bottom opening. The side wall is adapted for being coupled to a ceiling panel. The insulation housing further includes a top face adapted for defining an interior space for receiving a light fixture therein.

6 Claims, 2 Drawing Sheets

LIGHT FIXTURE THERMAL INSULATOR

BACKGROUND OF THE INVENTION

1. Field of the Invention

The present invention relates to light fixtures and more particularly pertains to a new light fixture thermal insulator for precluding a conventional temperature automatic shut off switch within a light from triggering.

2. Description of the Prior Art

The use of light fixtures is known in the prior art. More specifically, light fixtures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,237,671; U.S. Pat. No. 4,754,377; U.S. Pat. No. 4,930,054; U.S. Pat. No. 1,844,639; U.S. Pat. No. Des. 329,537; and U.S. Pat. No. 4,238,815.

In these respects, the light fixture thermal insulator according to the present invention substantially departs from the conventional concepts and designs of the prior art, and in so doing provides an apparatus primarily developed for the purpose of precluding a conventional temperature automatic shut off switch within a light from triggering.

SUMMARY OF THE INVENTION

In view of the foregoing disadvantages inherent in the known types of light fixtures now present in the prior art, the present invention provides a new light fixture thermal insulator construction wherein the same can be utilized for precluding a conventional temperature automatic shut off switch within a light from triggering.

The general purpose of the present invention, which will be described subsequently in greater detail, is to provide a new light fixture thermal insulator apparatus and method which has many of the advantages of the light fixtures mentioned heretofore and many novel features that result in a new light fixture thermal insulator which is not anticipated, rendered obvious, suggested, or even implied by any of the prior art light fixtures, either alone or in any combination thereof.

To attain this, the present invention is adapted for use with a ceiling frame having at least one horizontally oriented elongated truss with a small top face, a small bottom face, and a pair of large side faces. The ceiling frame further includes a drywall panel mounted to the bottom face of the truss with a square cut out formed therein. A side edge of the square cut out is coincident with the truss. An insulation housing is constructed from a rigid cardboard material. The housing includes four side faces each having a substantially planar rectangular configuration. The side faces have side edges being interconnected to define a square top opening and a square bottom opening. The side faces of the housing each have a substantially planar rectangular lower peripheral flange hingably coupled thereto at the bottom opening. Such lower peripheral flange is capable of extending outwardly therefrom in perpendicular relationship therewith for being coupled to a top surface of the drywall panel via a plurality of U-shaped staples. As such, the bottom opening of the housing remains aligned with the cut out. Ideally, each lower peripheral flange has a length equal to a width of the side faces of the housing and a width which is less than a length of the side faces of the housing. At least two of the side faces of the housing are each further equipped with a pair of substantially planar rectangular upper peripheral flanges hingably coupled thereto at the top opening. The upper peripheral flange is capable of extending inwardly from the top opening in perpendicular relationship therewith. Each upper peripheral flange has a length equal to a width of the side faces of the housing and a width which is about ½ that of the top opening. As such, the upper peripheral flanges define a top face. Each of the upper peripheral flanges has a pair of laterally spaced circular ventilation bores formed therein. The housing includes a U-shaped slit formed in one of the side faces. A portion of the instant side face of the housing is folded in an inverted L-shaped configuration for defining a slot which receives the truss.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light fixture thermal insulator apparatus and method which has many of the advantages of the light fixtures mentioned heretofore and many novel features that result in a new light fixture thermal insulator which is not anticipated, rendered obvious, suggested, or even implied by any of the prior art light fixtures, either alone or in any combination thereof.

It is another object of the present invention to provide a new light fixture thermal insulator which may be easily and efficiently manufactured and marketed.

It is a further object of the present invention to provide a new light fixture thermal insulator which is of a durable and reliable construction.

An even further object of the present invention is to provide a new light fixture thermal insulator which is susceptible of a low cost of manufacture with regard to both materials and labor, and which accordingly is then susceptible of low prices of sale to the consuming public, thereby making such light fixture thermal insulator economically available to the buying public.

Still yet another object of the present invention is to provide a new light fixture thermal insulator which provides in the apparatuses and methods of the prior art some of the advantages thereof, while simultaneously overcoming some of the disadvantages normally associated therewith.

Still another object of the present invention is to provide a new light fixture thermal insulator for precluding a conventional temperature automatic shut off switch within a light from triggering.

Even still another object of the present invention is to provide a new light fixture thermal insulator that includes an insulation housing having a side wall defining a bottom opening. The insulation housing includes a peripheral flange mounted to the side wall and extending outwardly therefrom adjacent to the bottom opening. The side wall is adapted for being coupled to a ceiling panel. The insulation housing further includes a top face adapted for defining an interior space for receiving a light fixture therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
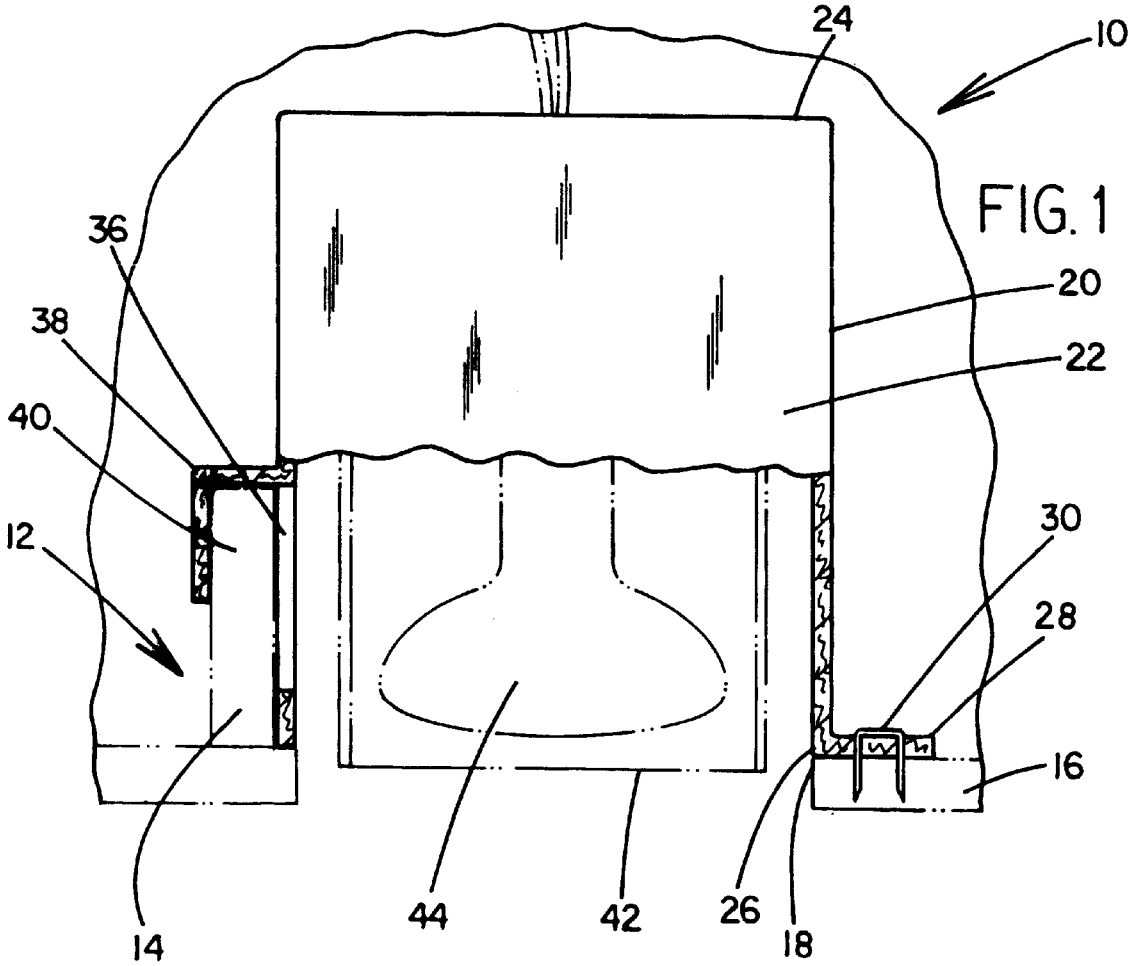
FIG. 1 is a side sectional view of a new light fixture thermal insulator according to the present invention.

With reference now to the drawings, and in particular to FIGS. 1 through 4 thereof, a new light fixture thermal insulator embodying the principles and concepts of the present invention and generally designated by the reference numeral 10 will be described.

The present invention, designated as numeral 10, is adapted for use with a ceiling frame 12 having at least one horizontally oriented elongated truss 14 with a small top face, a small bottom face, and a pair of large side faces. The ceiling frame further includes a drywall panel 16 mounted to the bottom face of the truss with a square cut out 18 formed therein. As shown in FIG. 1, a side edge of the square cut out is coincident with the truss.

The present invention includes an insulation housing 20 constructed from a rigid cardboard material. In the alternative, the housing may also be constructed from a plastic or metal material. As shown in the Figures, the housing include's four side faces 22 each having a substantially planar rectangular configuration. The side faces have side edges being interconnected to define a square top opening 24 and a square bottom opening 26.

The side faces of the housing each have a substantially planar rectangular lower peripheral flange 28 hingably coupled thereto at the bottom opening. Such lower peripheral flange is capable of extending outwardly from the associated side face of the housing in perpendicular relationship therewith for being coupled to a top surface of the drywall panel via a plurality of U-shaped staples 30. It should be noted that the lower peripheral flange adjacent the truss may be folded upwardly against the associated side face. As such, the bottom opening of the housing remains aligned with the cut out in the ceiling drywall panel. Ideally, each lower peripheral flange has a length equal to a width of the side faces of the housing and a width which is less than a length of the side faces of the housing. Note FIG. 2.

Figure 2:
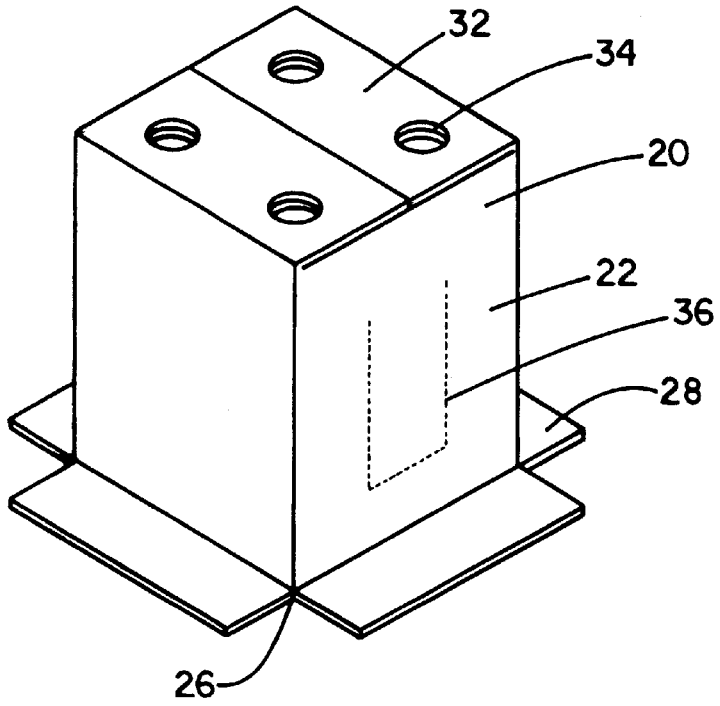
FIG. 2 is a perspective view of the present invention.
Figure 3:
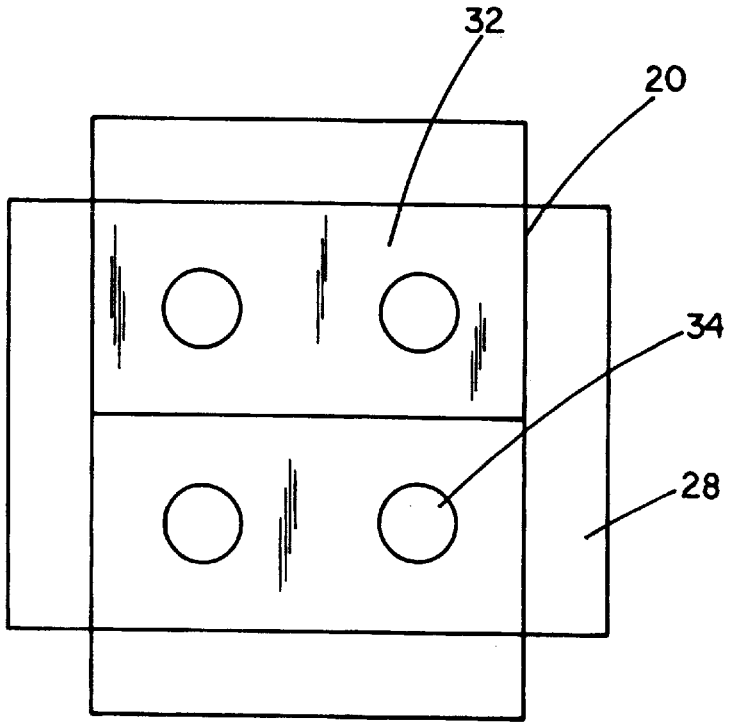
FIG. 3 is a top view of the present invention.
Figure 4:
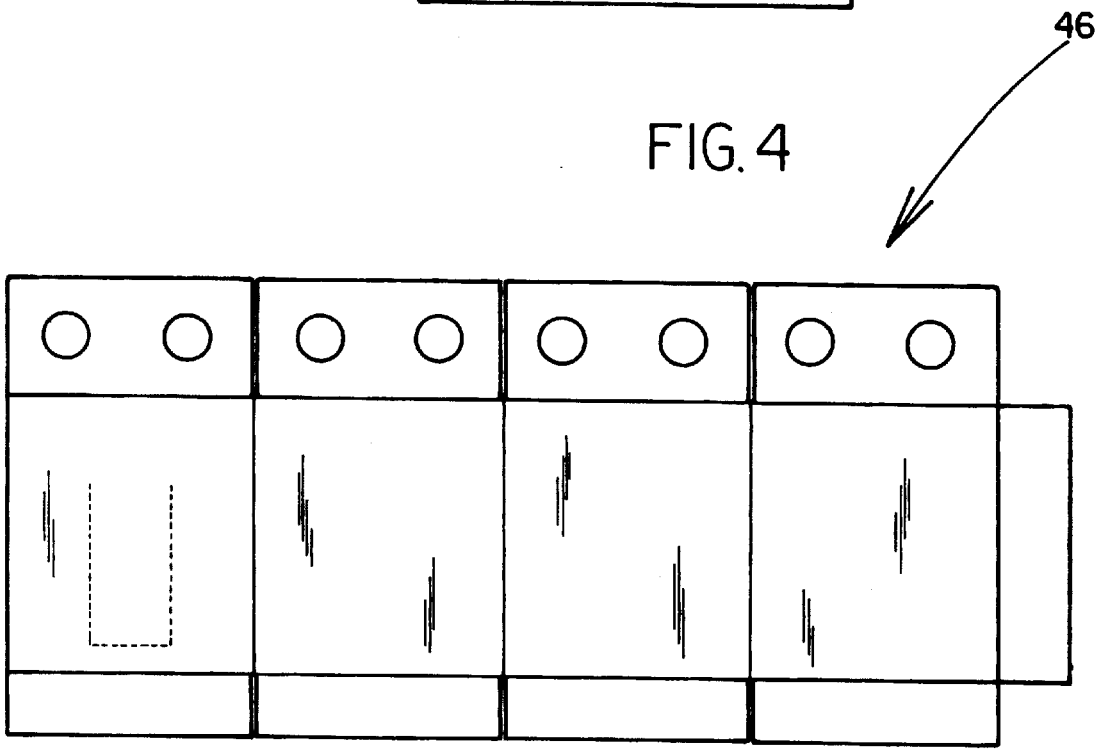
FIG. 4 is a side view of an alternate embodiment of the present invention in a folded orientation.

At least two side faces of the housing are each further equipped with a pair of substantially planar rectangular upper peripheral flanges 32 hingably coupled thereto at the top opening. It should be noted that the upper and lower peripheral flanges of the housing are hingably coupled to the corresponding side faces via a living hinge. The upper peripheral flange is capable of extending inwardly from the top opening in perpendicular relationship therewith. Each upper peripheral flange has a length equal to a width of the side faces of the housing and a width which is about ½ that of the top opening. As such, the upper peripheral flanges define a top face. As an option, each of the side faces may be equipped with an upper peripheral flange such that the same overlap when folded inwardly. As shown in FIGS. 2 & 3, each of the upper peripheral flanges has a pair of laterally spaced circular ventilation bores 34 formed therein.

Finally, the housing includes a U-shaped slit 36 formed in one of the side faces. By this structure, a portion of the instant side face of the housing is folded in the shape of an arm 38 having an inverted L-shaped cross-section for defining a slot 40 which receives the truss.

In use, a light fixture 42 with a cylindrical casing is mounted to the top face of the housing for residing therein. The light fixture has a light 44 positioned therein for illuminating upon the actuation thereof. It is imperative that the casing of the light fixture is spaced from the side faces of the housing. Insulation within the ceiling frame is thus maintained in spaced relationship with the casing in order to maintain the same cool. This is imperative for precluding a conventional temperature automatic shut off switch within the light from triggering. The present invention further prevents conventional insulation from entering a living area from the ceiling frame.

Ideally, a top face of the light fixture is coupled to each of the upper peripheral flanges of the housing in order to prevent the top face from collapsing. It should be noted that any electrical connections may be strung through one of the ventilation bores. In the alternative, mounting brackets may be positioned through the top face of the housing for fixing the light fixture with respect to the ceiling panel.

In an alternate embodiment 46, the housing may be configured to define a plurality of adjacent compartments. In operation, each of the compartments is adapted to be separated for receiving a light fixture therein. Note FIG. 4. In each of the previous embodiments, the housing is adapted for folding to facilitate storage and shipping.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An insulated fixture system comprising, in combination:

a ceiling frame including at least one horizontally oriented elongated truss having a small top face, a small bottom face, and a pair of large side faces, the ceiling frame further including a drywall panel mounted to the bottom face of the truss and having a square cut out formed therein with a side edge being coincident with the truss;

an insulation housing constructed from a rigid cardboard material including four side faces each having a substantially planar rectangular configuration, the side faces having side edges being interconnected to define a square top opening and a square bottom opening, the side faces each having a substantially planar rectangular lower peripheral flange hingably coupled thereto at the bottom opening and capable of extending outwardly therefrom in perpendicular relationship therewith for being coupled to a top surface of the drywall panel via a plurality of U-shaped staples such that the bottom opening of the housing remains aligned with the cut out, each lower peripheral flange having a length equal to a width of the side faces of the housing and a width which is less than a length of the side faces of the housing, at least two of the side faces of the housing having a pair of substantially planar rectangular upper peripheral flanges hingably coupled thereto at the top opening and capable of extending inwardly therefrom in perpendicular relationship therewith, each upper peripheral flange having a length equal to a width of the side faces of the housing and a width which is about ½ that of the top opening such that the upper peripheral flanges defines a top face, wherein each of the upper peripheral flanges has a pair of laterally spaced circular ventilation bores formed therein;

said housing further including a U-shaped slit formed in one of the side faces such that a portion thereof is folded in an inverted L-shaped configuration for defining a slot which receives the truss; and a light fixture with a casing mounted to the top face of the housing for residing therein, the light fixture having a light positioned therein for illuminating upon the actuation thereof.

2. An insulated light fixture assembly comprising:

an insulation housing including a side wall defining a bottom opening;

said insulation housing including a peripheral flange mounted to the side wall and extending outwardly therefrom adjacent to the bottom opening for being coupled to a recipient surface;

said insulation housing further including a top face adapted for defining an interior space for receiving a light fixture therein; and wherein the top face of the housing is defined by a pair of upper flanges which are hingably coupled to the side wall of the housing, the peripheral flange of the housing is hingably coupled to the side wall of the housing, and the side wall of the housing has four side faces for allowing the housing to be folded to a substantially planar orientation.

3. An insulated light fixture assembly as set forth in claim 2 wherein the top face of the housing has a plurality of ventilation bores formed therein.

4. An insulated light fixture assembly as set forth in claim 2 and further including staples for mounting the peripheral flange to the recipient surface.

5. An insulated light fixture assembly as set forth in claim 2 wherein the housing is constructed from a rigid cardboard material.

6. An insulated light fixture assembly as set forth in claim 2 wherein the housing further includes an arm with an inverted L-shaped configuration for defining a slot which is adapted to receive a truss.

* * * * *